US007984519B1

(12) United States Patent
Hall

(10) Patent No.: US 7,984,519 B1
(45) Date of Patent: Jul. 26, 2011

(54) SELF-CONTAINED EXERCISE POOL

(76) Inventor: David E. Hall, Rock Island, IL (US)

( * ) Notice: Subject to any disclaimer, the term of this patent is extended or adjusted under 35 U.S.C. 154(b) by 912 days.

(21) Appl. No.: 11/986,572

(22) Filed: Nov. 23, 2007

Related U.S. Application Data

(60) Provisional application No. 60/860,641, filed on Nov. 22, 2006.

(51) Int. Cl.
*E04H 4/00* (2006.01)

(52) U.S. Cl. ..... 4/507

(58) Field of Classification Search ..... 4/506–509
See application file for complete search history.

(56) References Cited

U.S. PATENT DOCUMENTS 1,786,613 A * 12/1930 Hooper ..... 52/245
4,060,946 A * 12/1977 Lang et al. ..... 52/169.7
4,124,907 A * 11/1978 Laven ..... 52/169.7
4,464,802 A * 8/1984 Glonek et al. ..... 4/506

* cited by examiner

*Primary Examiner* — Huyen Le
(74) *Attorney, Agent, or Firm* — Hamilton IP Law, PC; Jay R. Hamilton; Charles A. Damschen

(57) ABSTRACT

A self-contained swimming pool for containment of water and generation of water currents therein for exercise, therapy and or rehabilitation of a user comprising a rigid frame 1 exteriorly located in relation to an inner water containment area 2. A set of water return channels 3 in communication with the inner water containment area 2. A propulsion system 4 in communication with the set of water return channels 3 and the inner water containment area 2. A hydraulic system 5 for driving the propulsion system 4 using a hydraulic fluid 6 to produce a current 7 in the inner water containment area 2 allowing positioning of a user 12 in the current 7 for exercise, therapy and or rehabilitation therein and wherein the hydraulic system 5 is self-contained and mounted external of the rigid frame 1.

7 Claims, 16 Drawing Sheets

SELF-CONTAINED EXERCISE POOL

Applicant, David E. Hall, a United States citizen, does herein claim priority under 35 U.S.C. §119(e) of provisional U.S. Patent Application Ser. No. 60/860,641 filed on Nov. 22, 2006 which is incorporated by reference herein.

FIELD OF INVENTION

Swimming pools and more particularly, self-contained swimming pools that can generate currents of various speeds for exercise, therapy and rehabilitation.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable

AUTHORIZATION PURSUANT TO 37 C.F.R. §1.171 (d)(c)

A portion of the disclosure of this patent document contains material which is subject to copyright and trademark protection. The copyright owner has no objection to the facsimile reproduction by anyone of the patent document or the patent disclosure, as it appears in the Patent and Trademark Office patent file or records, but otherwise reserves all copyrights whatsoever.

BACKGROUND OF PRIOR ART

Continuous swimming tanks are known generally. German Patent No. 2,222,594 issued to Hoppe shows a continuous swimming tank. In the tank described therein, water circulates from the front of a swimming area past the swimmer to the rear of the swimming area where it is recalculated through a duct which runs beneath the floor of the swimming area. One set of turning vanes directs the water from the swimming area to the recirculation duct. The water passes over a propeller located in the duct and used for circulation. The second set of turning vanes directs the water from the recirculation duct back into the front of the swimming area.

The swimming area shown in the German '594 patent widens from the front of the tank to the rear of the tank. That is, the cross-sectional area of the swimming area increases from the front to the rear of the tank. This results in velocity variations over the length of the tank. The velocity of the flowing water is greater at the front of the swimming area than it is at the rear of the swimming area. Thus, a swimmer may choose where to swim, according to water velocity. The flow rate of water is constant anywhere in a given cross-section, perpendicular to the direction of water flow. The preceding prior art is incorporated by reference herein.

The problem with such a design is that it requires a large swimming area and thus a large swimming tank. Further, a large motor and great deal of power is required to circulate such a large volume of water.

U.S. Pat. No. 2,035,835 issued to Raber for "Swimming Bath" shows a continuous swimming tank. In this reference, water is circulated either beneath the floor of the swimming area or around the sides of the swimming area. No turning vanes are used to direct the water. The problem with such a tank is that large amounts of turbulence are developed, and loss of water velocity results. Therefore, more power is needed to circulate the water, and swimming comfort is adversely affected by the turbulence. The preceding prior art is incorporated by reference herein.

U.S. Pat. No. 5,044,021 issued to James Murdock for a "Continuous swimming apparatus" discloses and claims swim treadmill which is said to avoid the power and size shortcomings of the prior art by providing a compact swimming apparatus. The apparatus consists essentially of a tank adapted to contain water and having a swimming area within the tank. Water flows through the swimming area from a water entrance end to a water exit end and returns to the water entrance end via a return path. Water circulation means is included in the return path for propelling the water through the return path and through the swimming area. A plurality of vanes is located in the return path to direct the water from the return path to the entrance end of the swimming area and from the exit end of the swimming area to the return path. The vanes help to minimize power losses by minimizing water turbulence. The vanes are spaced in such a way as to create a horizontal velocity gradient across the swimming area whereby water closer to the center of the swimming area has a higher velocity than water near the sides of the swimming area. The preceding prior art is incorporated by reference herein.

Additional prior art of interest include U.S. Pat. No. 1,731,554 issued to M. I. Wheeler for "Swimming Pool" and U.S. Pat. No. 722,232 issued to Hoeglauer for "Bathtub". The preceding prior art is incorporated by reference herein.

SUMMARY OF INVENTION

Referring now to the drawings, FIG. 1 is a simplified perspective view of the major components comprising the self-contained exercise pool disclosed and claimed herein. As shown, the pool is comprised of an externally positioned power system used to drive a hydraulic system which is connected by hydraulic hoses to and drives a water propulsion system. See FIG. 1. The quality of the water used is maintained by the water quality system which continually processes a slipstream of the water contained within the self-contained swimming pool. See FIG. 1.

The propulsion system is mounted at a first end of the self-contained swimming pool for containment of water and generation of water current flows. The water current flows delivered from the first end to the second end of the pool for exercise, therapy and or rehabilitation of a user. During operation, the user typically faces the propulsion unit. The self-contained exercise pool is sized so that during operation a user may swim or exercise against the current generated by the propulsion system. The inner water containment area is created by a rigid frame around the outer perimeter therein. A set of water return channels within intake ports at the second end of the pool allow the return of the water current flows back to the propulsion system. To maximize user functionality, a seating surface has been placed upon the water return channels to allow for user seating on either side of the water current flows.

As illustrated in FIGS. 1, 4 and 7, the self-contained exercise pool disclosed and claimed herein may be adapted for various types and sizes of top decorative surfaces including an eight (8") inch walk-way as shown at FIGS. 2-4 and a two foot (2') walkway as shown at FIGS. 7-9. As required by local regulations, the self-contained exercise pool as described herein may be adapted for grounding through installation of grounding straps along the bottom portion of the tension straps.

FIGS. 4-6 illustrate the steel supports of the self-contained exercise pool disclosed and claimed herein. FIG. 10 illustrates the tension straps of the self-contained exercise pool disclosed and claimed herein. The combination of the modular steel supports shown at FIG. 4 or FIG. 9 and the tension straps of FIG. 10 produce an interlocking frame structure of sufficient rigidity during operation that tile may be used as the top decorative surface. (See FIG. 11) The choice of tile for the top decorative surface improves the overall aesthetic of the self-contained exercise pool increasing user desirability.

The hydraulic pumping system is exteriorly mounted and also self-contained. The hydraulic pumping system has an electrically driven pump to circulate the glycol based pumping solution through hydraulic hoses connected to the propulsion system. The glycol solution chosen is non-toxic to humans and animals. Although the system as designed to minimize the potential for glycol to enter the water of the pool, however, if the glycol material does enter the water within the inner containment area, it is easily separated from the water through the filtration system of the pool. See FIG. 1. Because electrical pumping systems as well as hydraulic systems are well known in the art, further discussion is unnecessary as related to the present art.

It is well known in the prior art to use vegetable oil as the hydraulic fluid to drive the propulsion system. The problem with using vegetable oil as the hydraulic fluid is that if it introduced into the pool at any time, such as through leakage or spillage, the vegetable oil is immiscible with the water forming a separate layer. The vegetable oil forms a coating or film upon the inner layer of the pool. Furthermore, the filtration system of the prior art is not equipped to remove the vegetable oil from the water. Typically, the operator must remove the contents of the pool and thoroughly wash the unit which requires almost complete disassembly of the pool unit and its component parts so they may be washed down with soap and water prior to re-assembly.

The glycol based pumping solution of the present embodiment is designed for low maintenance and long use. Typically, viscosity breakdown of the glycol solution is of major concern to the prior art. The present system addresses this problem by maintaining a relatively constant temperature of the pumping solution by using a heat exchanger positioned in the inner water circulation area to allow transfer of any excess heat built up in the pumping solution to be transferred to the circulated water. (Not shown) This innovation solves the viscosity breakdown problem. The glycol solution, should it be mixed into the water, through leakage or spillage, is easily removed the existing filtration system. Minor hydraulic fluid leaks of the glycol water solution are hardly noticed by the user. Major glycol leaks into the water of the pool typically present a cloudy appearance which is easily corrected by draining the pool, fixing the leak and refilling the pool with water. No disassembly of the pool or its major components is necessary.

It is therefore an objective of the present invention to create a self-enclosed swimming pool for use as a water treadmill for use in exercise or rehabilitation.

It is another objective of the present invention for the self-enclosed swimming pool to be self-supporting.

It is another objective of the present invention for the rigid frame of the self-enclosed swimming pool to be modular in design to allow for improved delivery and assembling.

It is also an objective of the present invention for the self-enclosed swimming pool to drive the propulsion system with a hydraulic system with a solution which is non-toxic to both humans and pets.

DETAILED DESCRIPTION

Listing of Elements

| ELEMENT DESCRIPTION | ELEMENT # |
|---|---|
| Rigid Frame | 1 |
| Inner Water Containment Area | 2 |
| Water Return Channel | 3 |
| Propulsion System | 4 |
| Hydraulic System | 5 |
| Hydraulic Fluid | 6 |
| Coping [Current] | 7 |
| Decorative Horizontal Surface | 8 |
| Modular Interlocking Panels | 9 |
| Tension Straps | 10 |
| PVC Piping | 11 |
| Intentionally Blank | 12 |
| Mounting Strap | 13 |
| Housing | 14 |
| Intentionally Blank | 15 |
| Power System | 16 |
| Wall Support Covers | 17 |
| Hydraulic Line(s) | 18 |

-continued

| ELEMENT DESCRIPTION | ELEMENT # |
|---|---|
| Propulsion System Housing | 19 |
| Self-contained Swimming Pool | 20 |
| Water Quality System | 21 |
| Drain | 22 |
| Underwater Benches | 23 |
| Horizontal Wall Supports | 24 |
| Current | 25 |
| [Suction (Water Return Channel)] | 26 |
| Intentionally Blank | |
| Pool Panels (walls) | 27 |
| Pool Panel (interior side) | 28 |
| Pool Panel (exterior side) | 29 |
| Plain Walkway (8") | 30 |
| Walkway (2') | 31 |
| 90 Degree Corner Supports | 32 |
| Top Corner Piece | 33 |
| Adjustable Screw Plate | 34 |
| Wall Seam Connecting Plate | 35 |
| Wall & Deck Support | 36 |
| Suction Tunnel | 37 |
| Seam Joint | 38 |
| Corner Tunnel | 39 |
| Water Return Inlet | 40 |
| Water Return Screen | 41 |
| Top Seat Pie Stiffener | 42 |
| Locking Slot | 43 |
| Bottom Wall Plate | 44 |
| $1^{st}$ Side | 45 |
| $2^{nd}$ Side | 46 |
| $3^{rd}$ Side | 47 |
| $4^{th}$ Side | 48 |
| Water Line | 49 |
| Fastener | 50 |

Detailed Description

Figure 1:
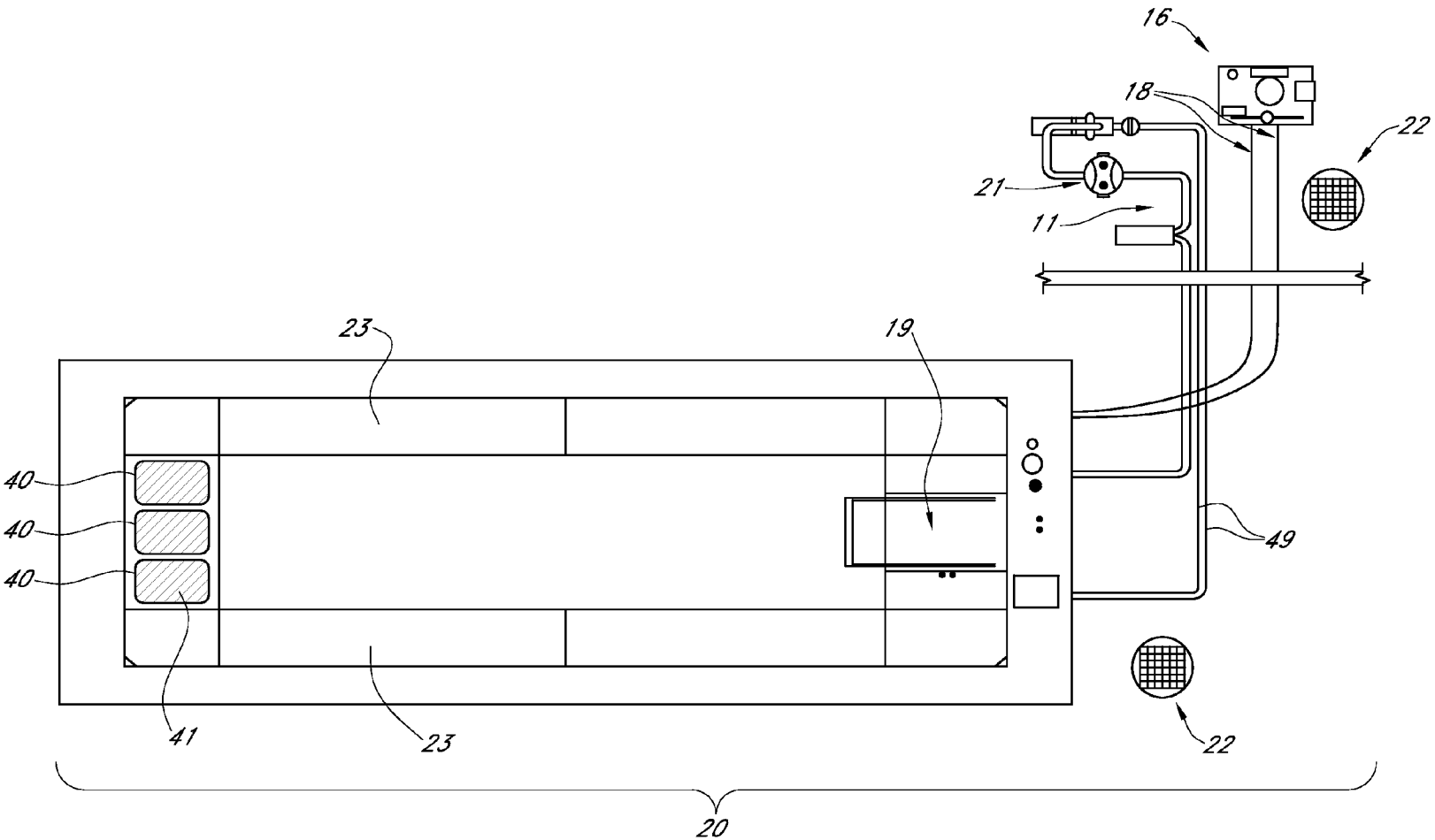
FIG. 1 is a simplified perspective view of the major components comprising the self-contained exercise pool disclosed and claimed herein.

Referring now to the drawings, FIG. 1 is a simplified perspective view of the major components comprising the self-contained exercise pool 20 disclosed and claimed herein. As shown, the pool 20 is comprised of an externally positioned power system used to drive a hydraulic system which is connected by hydraulic hoses to and drives a water propulsion system. The quality of the water used is maintained by the water quality system which continually processes a slip-stream of the water contained within the system.

Figure 6:
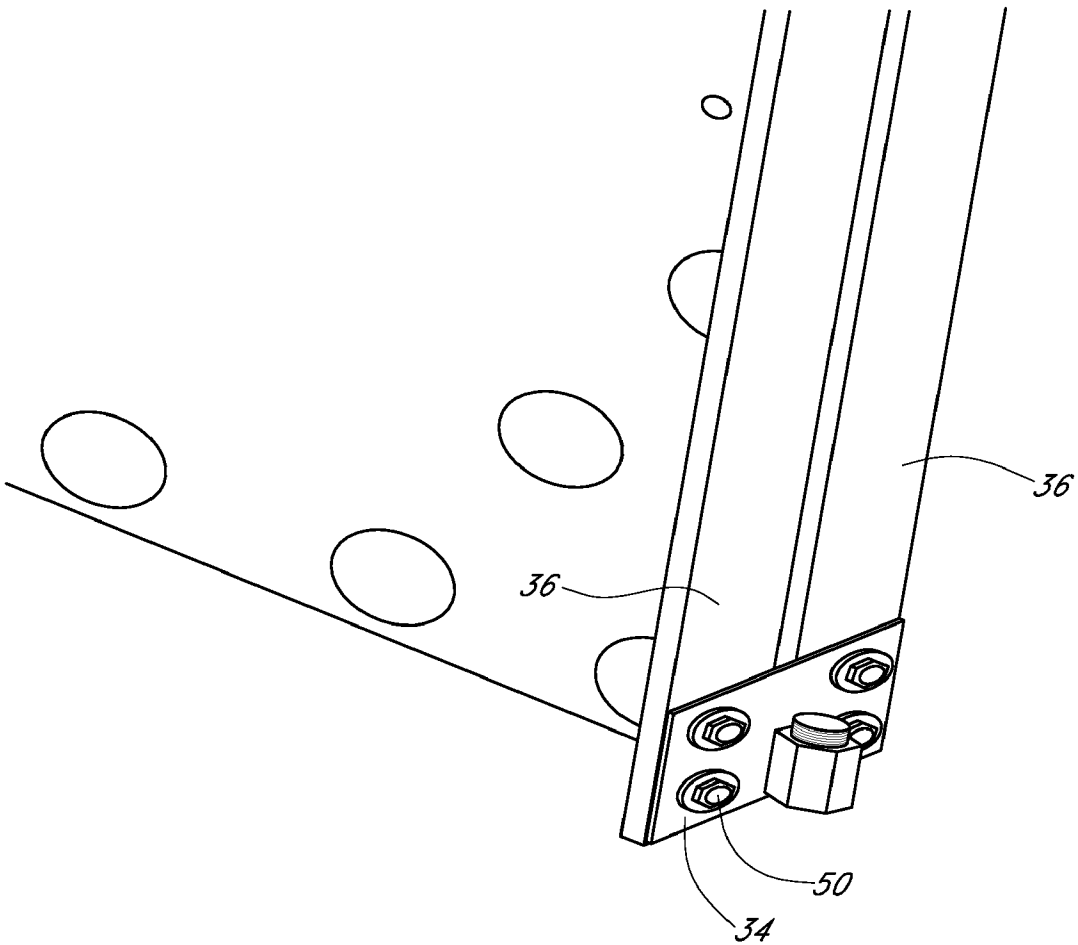
FIG. 6 illustrates the lower area of attachment of adjacent deck and wall supports as shown in FIG. 4.
Figure 7:
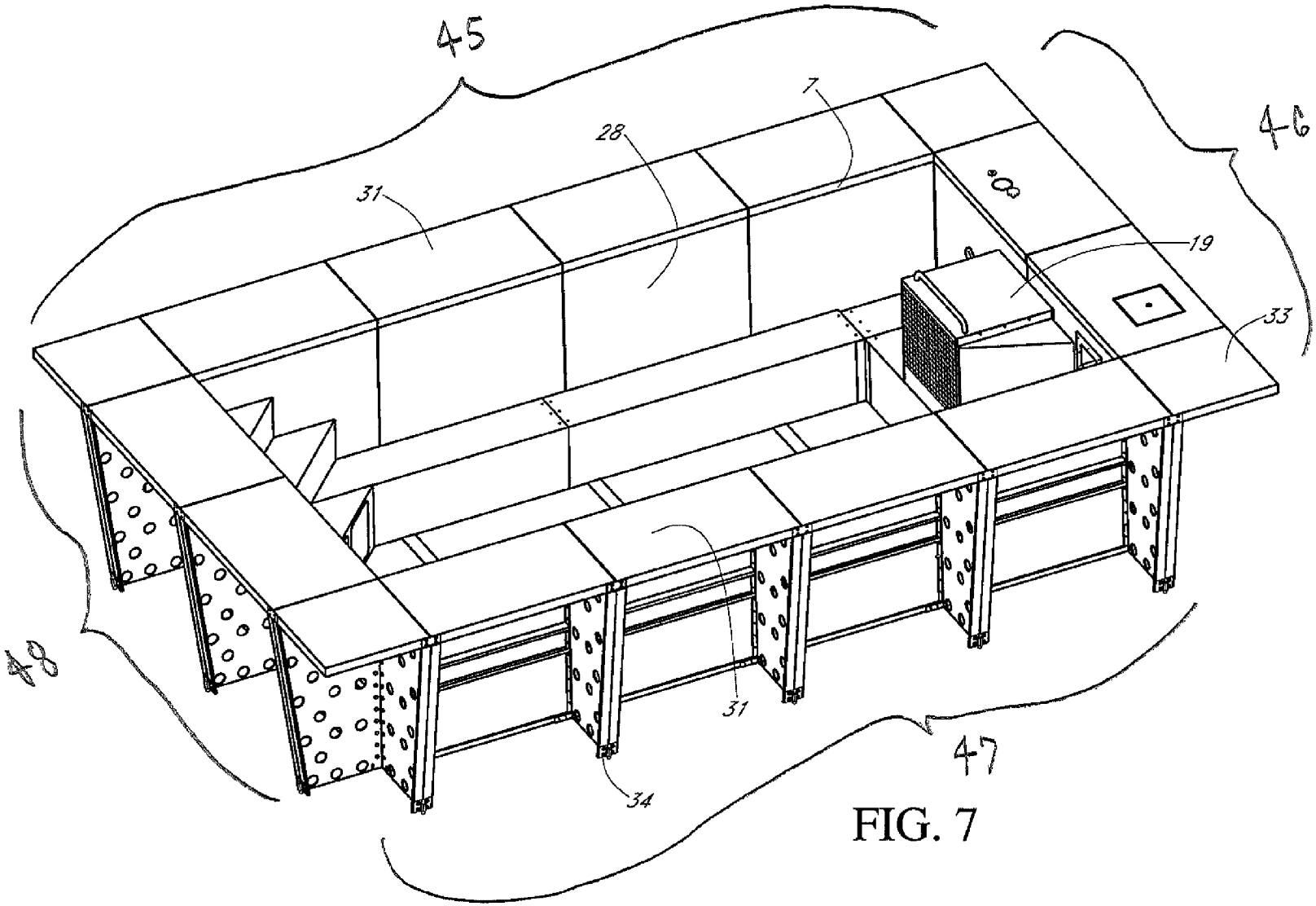
FIG. 7 is another embodiment of the self-contained exercise pool disclosed and claimed herein adapted for a two foot (24") inch walk-way.

The self-contained swimming pool 20 illustrated in FIGS. 1-16 is constructed for the containment of water and generation of water currents which are useful for exercise, therapy and or rehabilitation of a user. The self-contained swimming pool 20 is comprised of a rigid frame 1 which is exteriorly located and surrounds an inner water containment area 2 having a first side 45, a second side 46, a third 47 and a fourth side 48. As illustrated in FIGS. 1, 3, and 7 the rigid frame 1 is comprised of a plurality of pool panels 27 having a first side (interior) 28 and second side 29 (exterior). The first side of the pool panels 28 has a relatively smooth surface and is positioned to face the inner water containment area 2. The second side of the pool panels 29 is positioned to face the exterior and be supported by a plurality of vertically orientated wall and deck supports 36 positioned around the perimeter of the inner water containment area 2. The second side of the pool panels 29 attaches to the plurality of wall and deck supports 36. The rigid frame 1 is also composed of a plurality of horizontally orientated wall supports 24 having a first and second side connected to and between the plurality of vertically orientated wall and deck supports 36 and wherein the first side of the plurality of horizontally orientated wall supports faces the second side of the plurality of pool panels 29.

Figure 14:
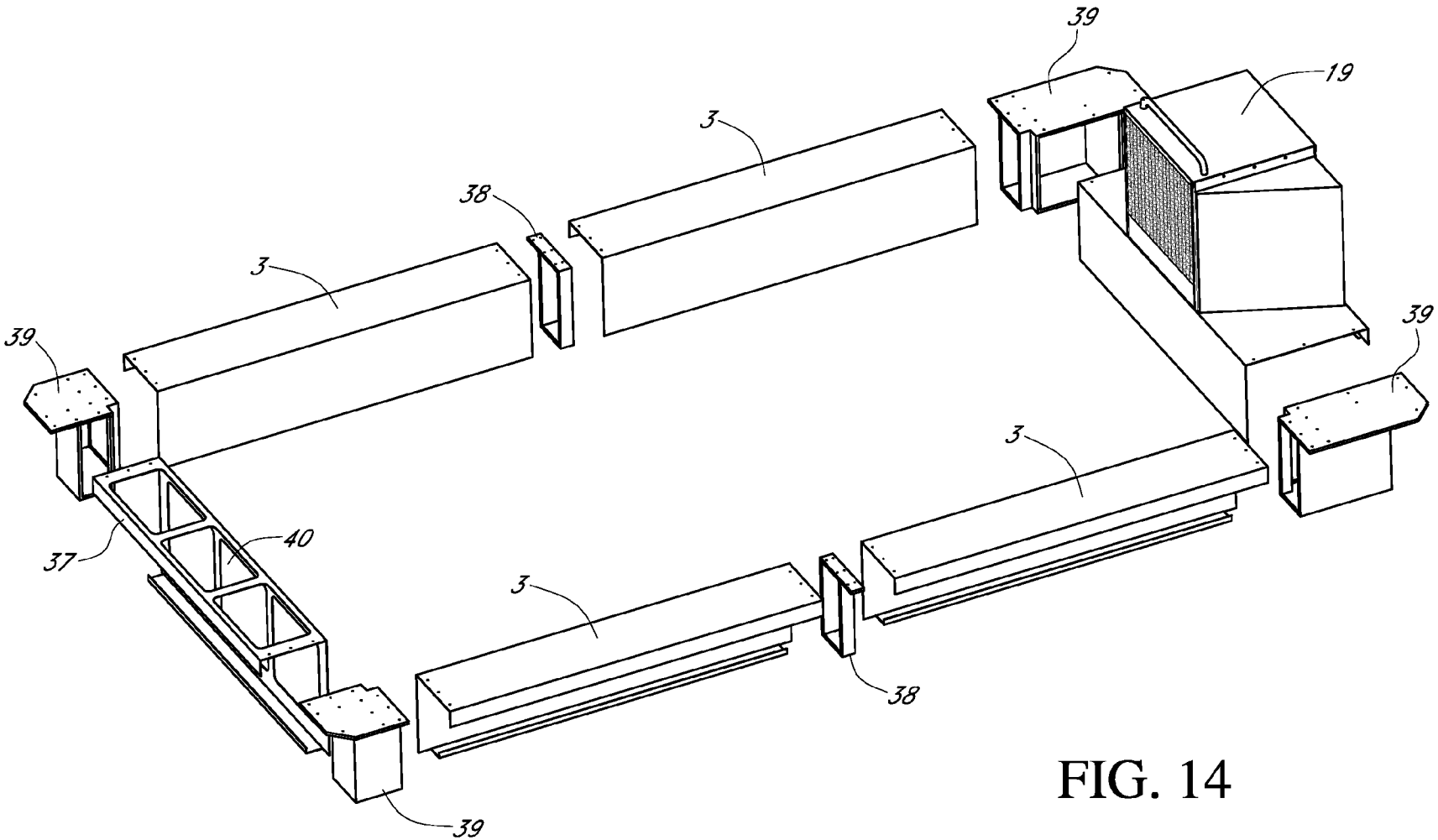
FIG. 14 illustrates the water return channels of the present art.

A plurality of tension straps 10 are attached to the first 45, second 46, third 47 and fourth 48 sides of the rigid frame 1. (See FIGS. 3, 4, 7, 8 and 9) A number of tension straps 10 are positioned to connect the opposing sides of first side 45 to the third side 47 of the rigid frame 1 to surround the inner water containment area 2 and a pre-determined number of the tension straps 10 are positioned to connect the second side 46 to the third side 47 of the inner water containment area 2. As shown, a plurality of wall seam connecting plates 35 are positioned at the upper exterior portion of the wall and deck supports 36 for attachment of the adjacent plurality of wall and deck supports 36. A plurality of adjustable screw plates 34 are then positioned at the lower exterior portion of the wall and deck supports 36 for attachment to the adjacent wall and deck supports 36. As best illustrated in FIG. 14, a set of water return channels 3 are positioned in communication with the inner water containment area 2 and positioned interior of the plurality of said pool panels (walls) 27. A propulsion system 4, which is externally driven, is positioned interiorly of the pool panels 27 and is in communication with the set of water return channels 3 and the inner water containment area 2. Typically, a hydraulic system 5 for driving the propulsion system 4 using a hydraulic fluid 6 to produce a current 25 in the inner water containment area 2. The hydraulic system 5 is self-contained and mounted external of the rigid frame 1. The self-contained swimming pool, when filled with water and during operation, allows the positioning of a user 12 (not shown) in the current 25 (not shown) for exercise, therapy and or rehabilitation therein.

Figure 2:
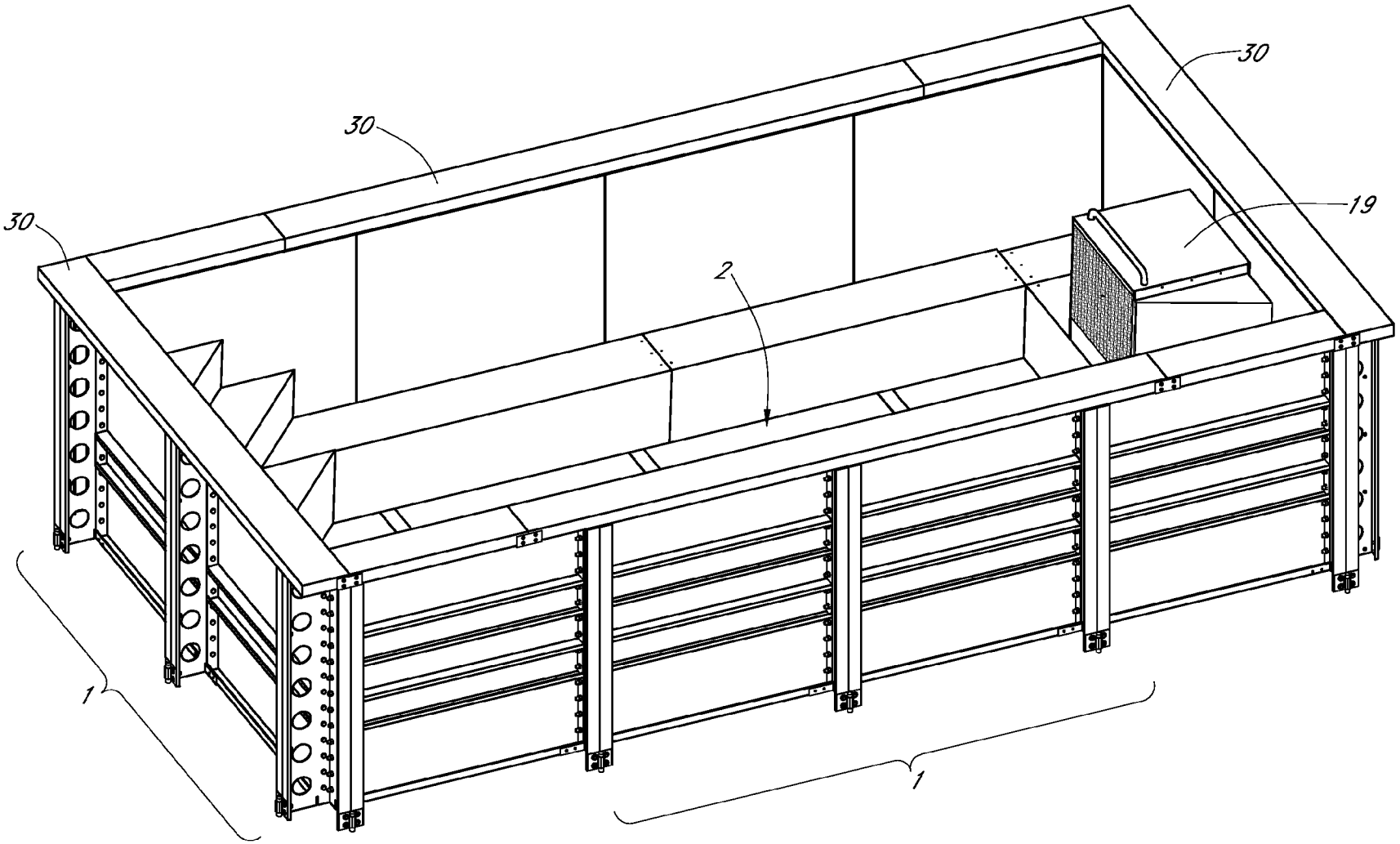
FIG. 2 is a first embodiment of the self-contained exercise pool disclosed and claimed herein adapted for an eight inch (8") walk-way.
Figure 3:
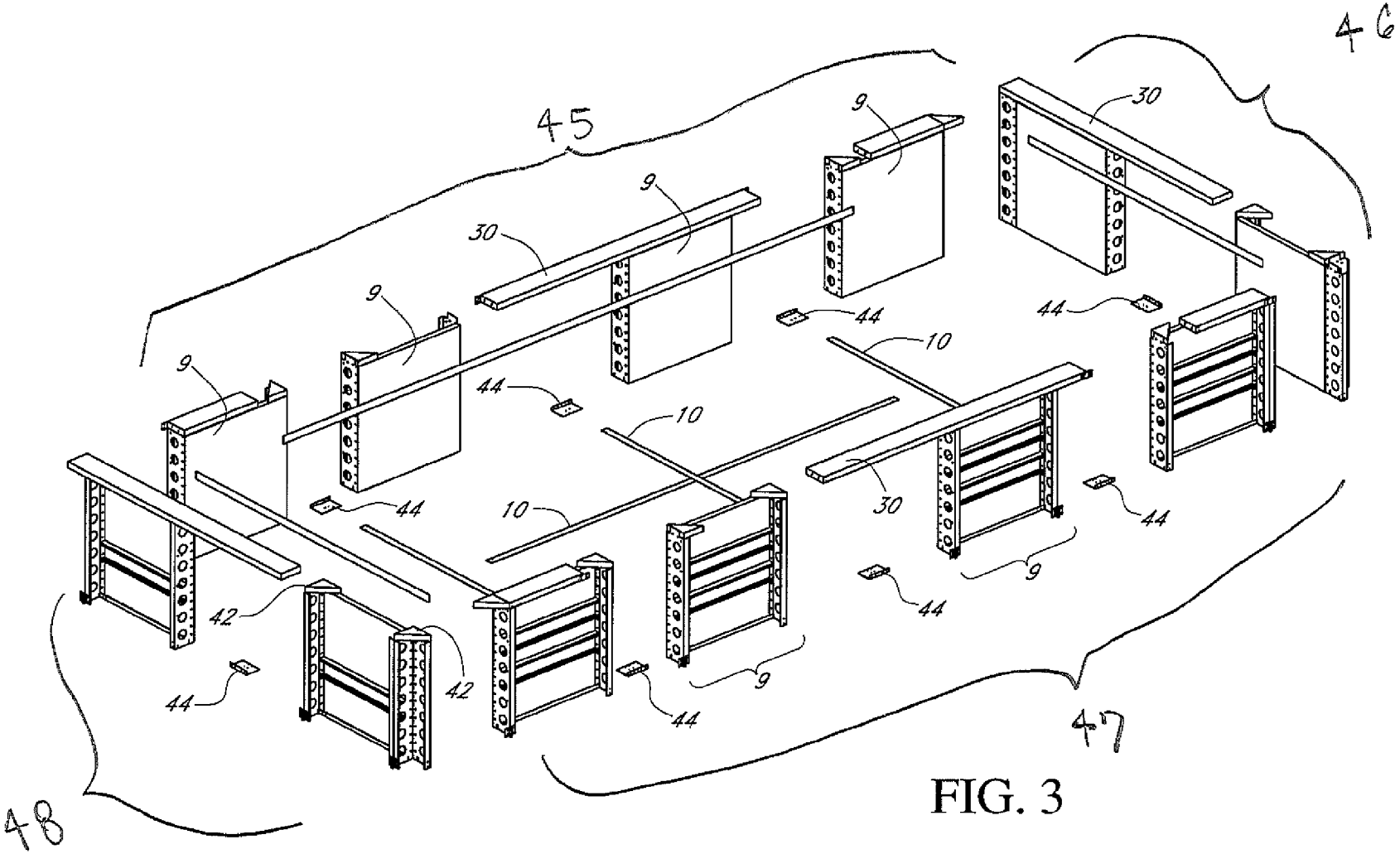
FIG. 3 is a deconstructed view of the embodiment of the self-contained exercise pool shown in FIG. 2 having an eight (8") inch walk-way.

FIG. 2 is a first embodiment of the self-contained swimming [exercise] pool 20 disclosed and claimed herein adapted for a plain walkway having a width of 8. One of ordinary skill in the art will appreciate that other sizes are possible and within in the purview of the present art.

Figure 4:
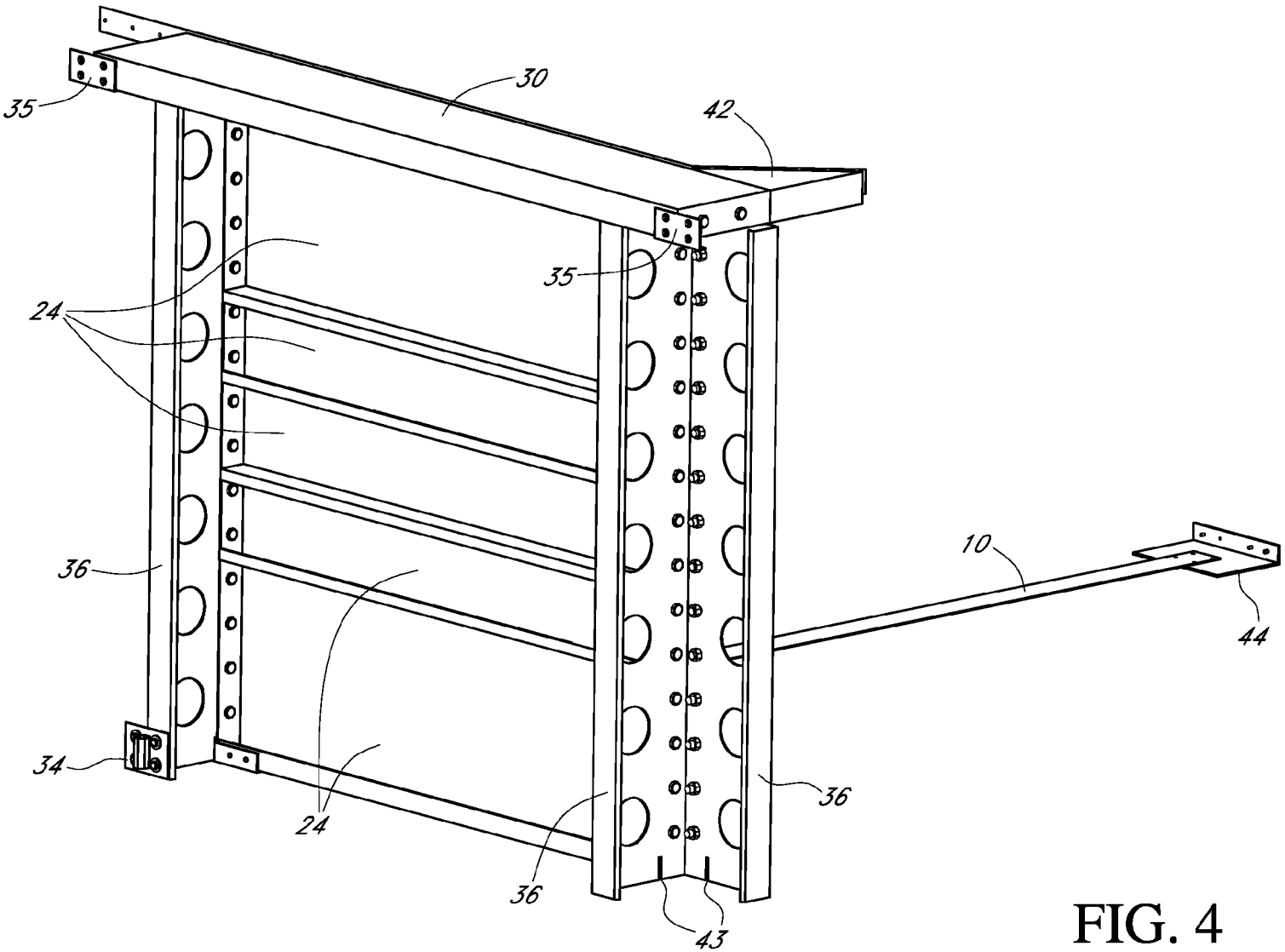
FIG. 4 is a deck and wall support for an 8" walk-way as shown in FIGS. 2-3.
Figure 10:
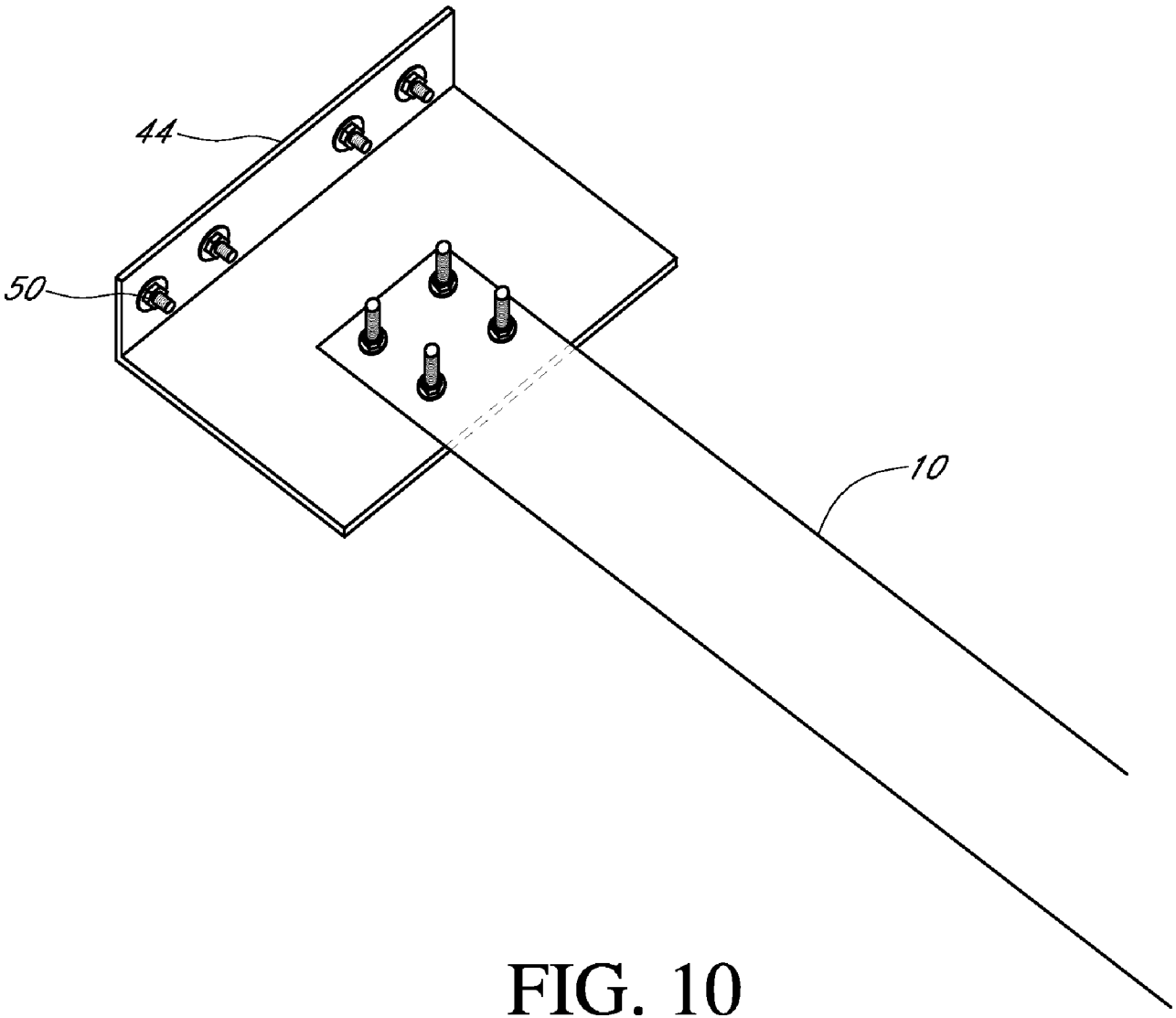
FIG. 10 illustrates a tension strap wall mount.
Figure 11:
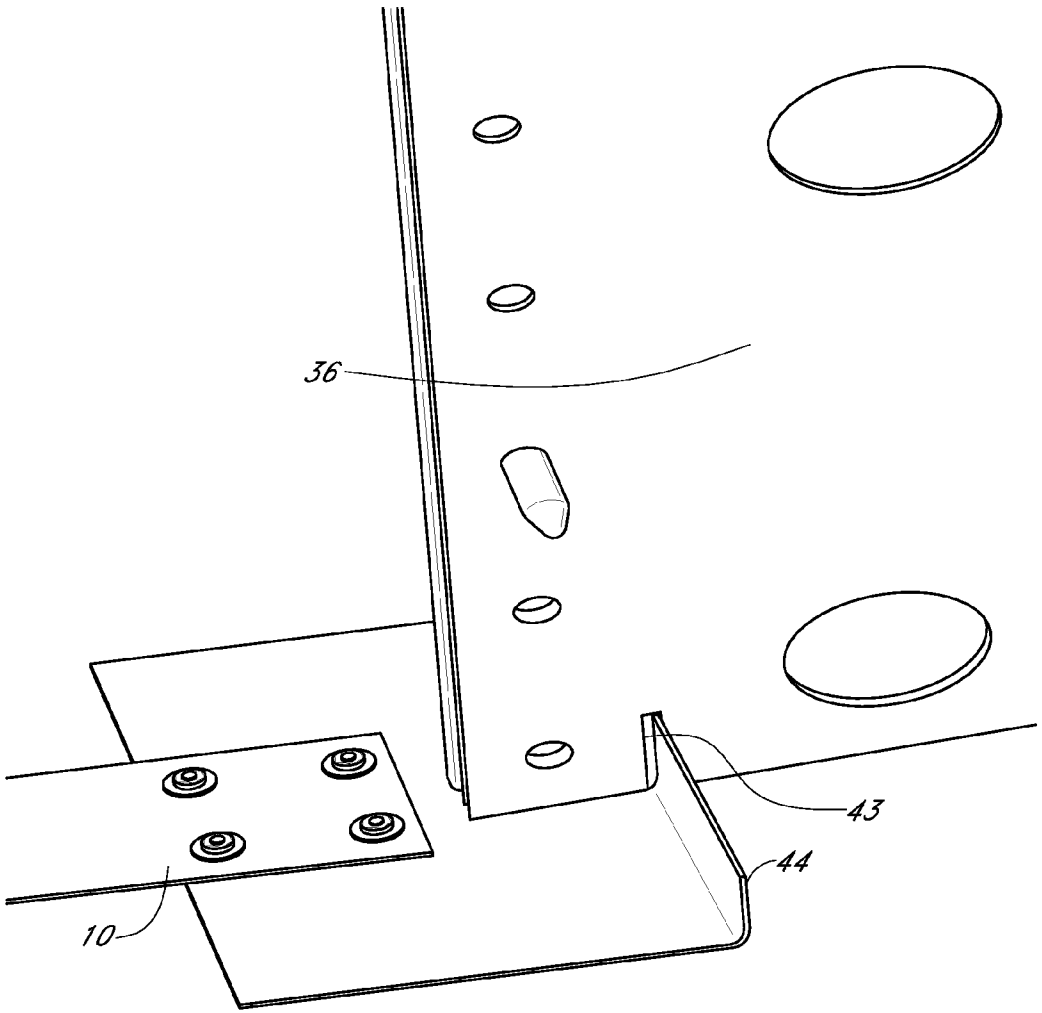
FIG. 11 illustrates a tension strap wall mount attached to the lower portion of a deck and wall support.

FIG. 3 is a deconstructed view of the embodiment of the self-contained swimming pool shown in FIG. 2 having an eight (8") inch walk-way. Furthermore, FIG. 3 also illustrates how bottom wall plate 44 is positioned at each end of the tension straps 10. FIG. 4 illustrates a deck and wall support for an 8" walk-way as shown in FIGS. 2-3 having a tension strap 10 connected to it. FIG. 10 illustrates a tension strap 10 connected to a wall mount 44. FIG. 11 illustrates the tension strap 10 connected to the wall mount 44 which is then attached to the lower portion of a deck and wall support 36 at locking slot 43.

Figure 5:
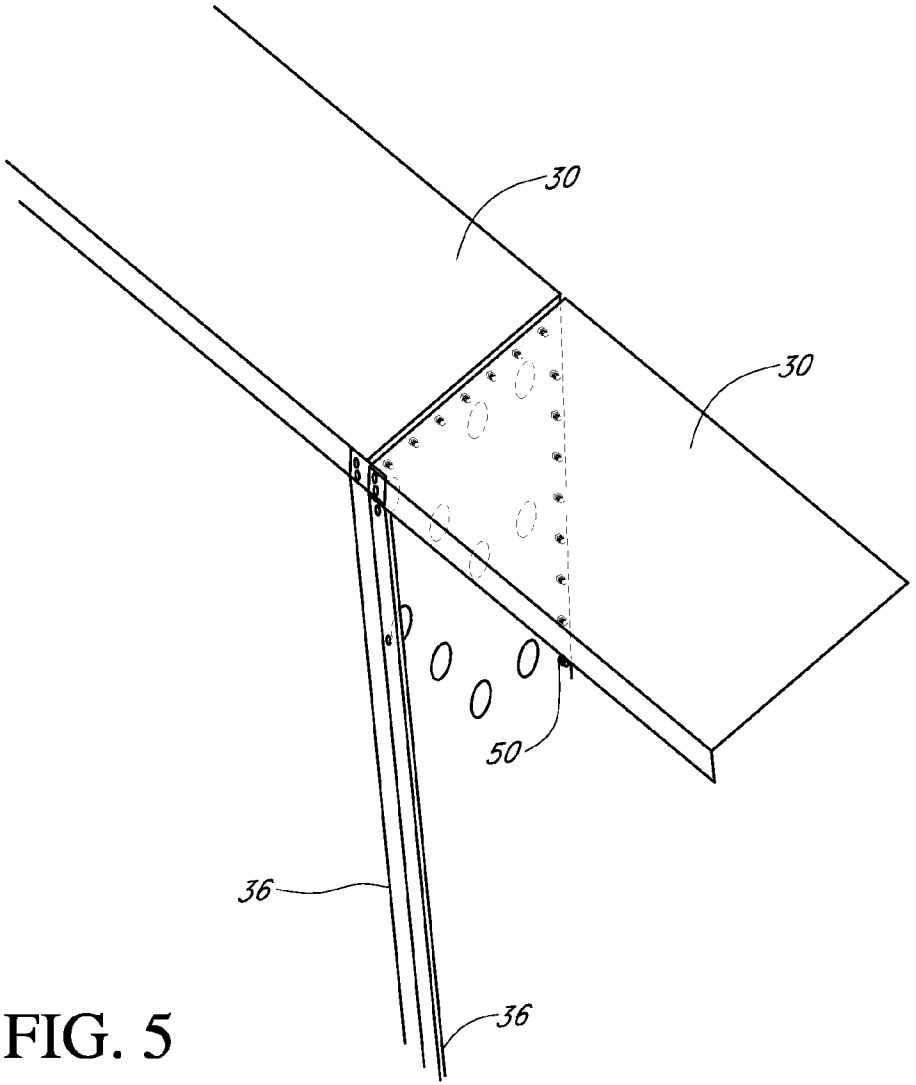
FIG. 5 illustrates the upper area of attachment of adjacent deck and wall supports as shown in FIG. 4.

FIG. 5 illustrates the upper area of attachment of the adjacent deck and wall supports 36 as shown in FIG. 4. The adjacent deck and wall supports 36 are rigidly connected to each other using fasteners 50, such as nuts and bolts, as is well known to those of ordinary skill in the art. A plain walkway 30 having a width of 8 inches is then positioned at the upper portion of the adjacent deck and wall supports 36. FIG. 6 illustrates the lower area of attachment of the adjacent deck and wall supports 36 as shown in FIG. 4. The adjacent deck and wall supports 36 are adjustably affixed to each other using an adjustable screw plate 34 and a combination of fasteners 50, such as nuts and bolts, as is well known to those of ordinary skill in the art.

Figure 8:
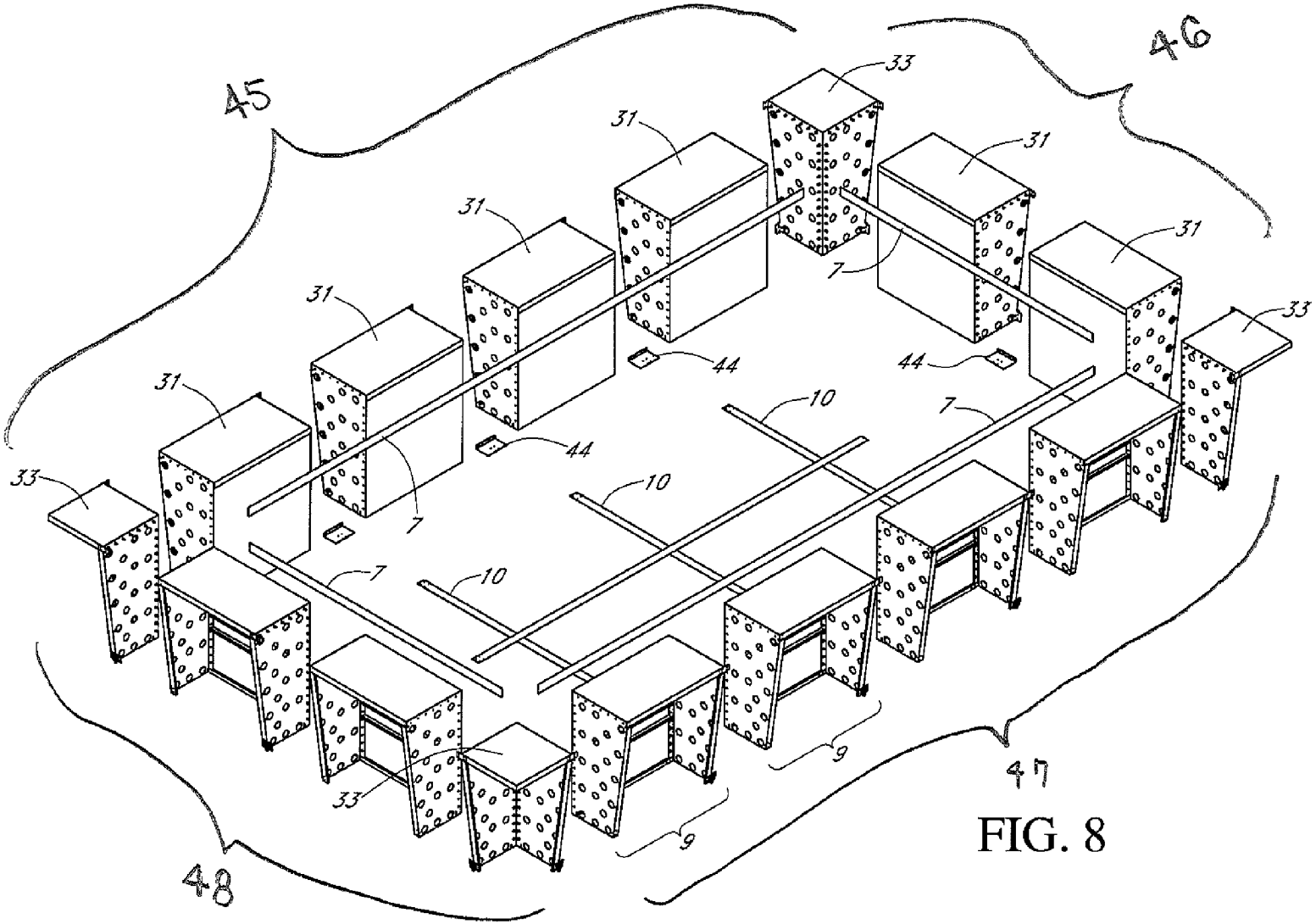
FIG. 8 is a deconstructed view of the embodiment of the self-contained exercise pool shown in FIG. 7 having a two foot (24") walk-way.
Figure 9:
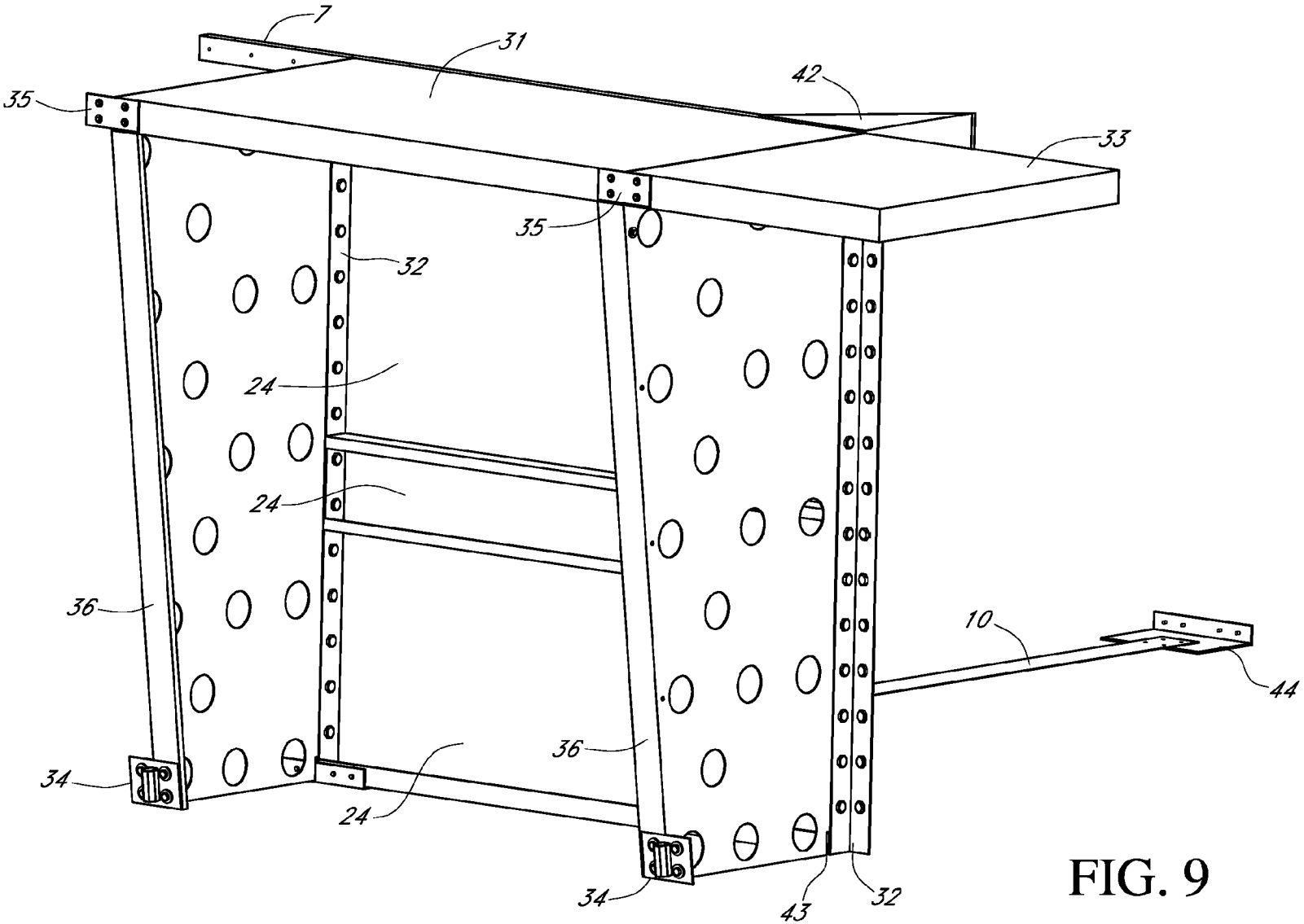
FIG. 9 illustrates a deck and wall support for a two foot (24") walk-way as shown in FIGS. 7-8.

FIG. 7 is another embodiment of the self-contained exercise pool 20 disclosed and claimed herein adapted for a two foot (24") inch walk-way 31. Coping 7, as shown in FIG. 7, may be mounted at the upper portion of the interlocking modular panels to lock in the pool liner (not shown) and create a seal between the self-contained swimming pool and either the 2' walkway 31, as shown. FIG. 8 is a deconstructed view of the embodiment of the self-contained exercise pool shown in FIG. 7 having a two foot (24") walk-way. FIG. 9 illustrates a deck and wall support for a two foot (24") walkway [an 8" walk-way] as shown in FIGS. 7-8. The rigid frame 1 surrounding the inner water containment area 2 of the self-contained swimming pool 20 is stable enough to allow the installation of the decorative horizontal surface 8, including walkway (2') 31 and top corner piece 33.

Figure 12:
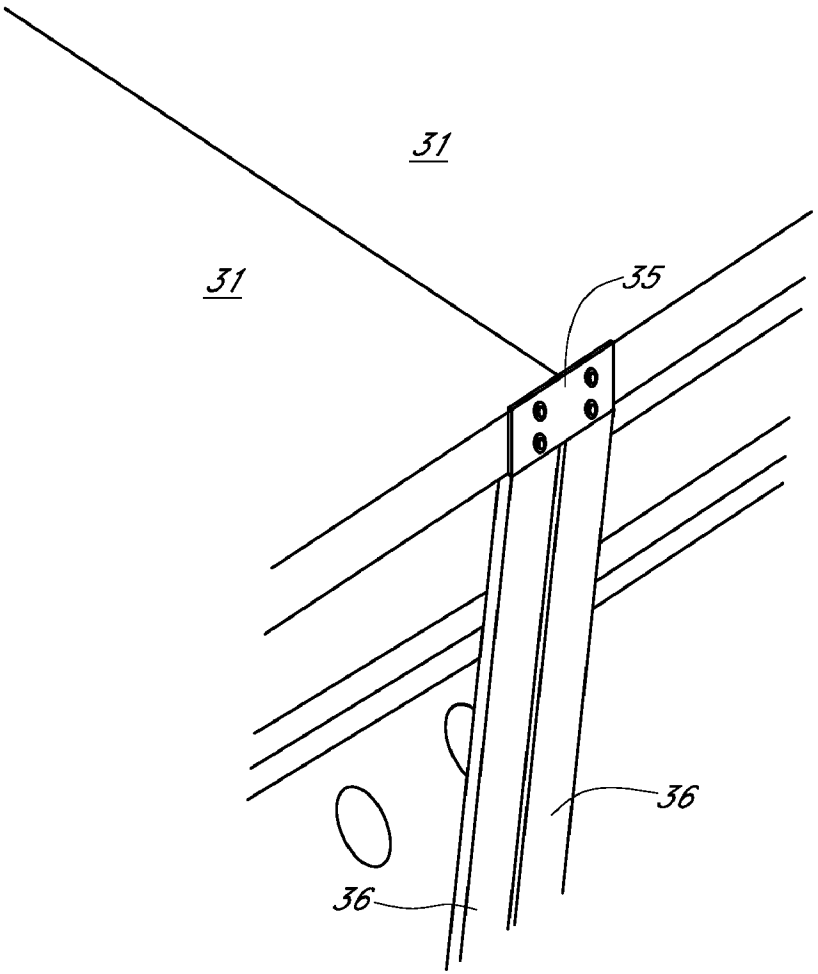
FIG. 12 illustrates the wall seam connecting plate fastened between adjacent deck and wall supports.

FIG. 12 illustrates the wall seam connecting plate 35 fastened between adjacent deck and wall supports 36 for rigidly connecting the upper portions of the wall and deck supports 36.

Figure 13:
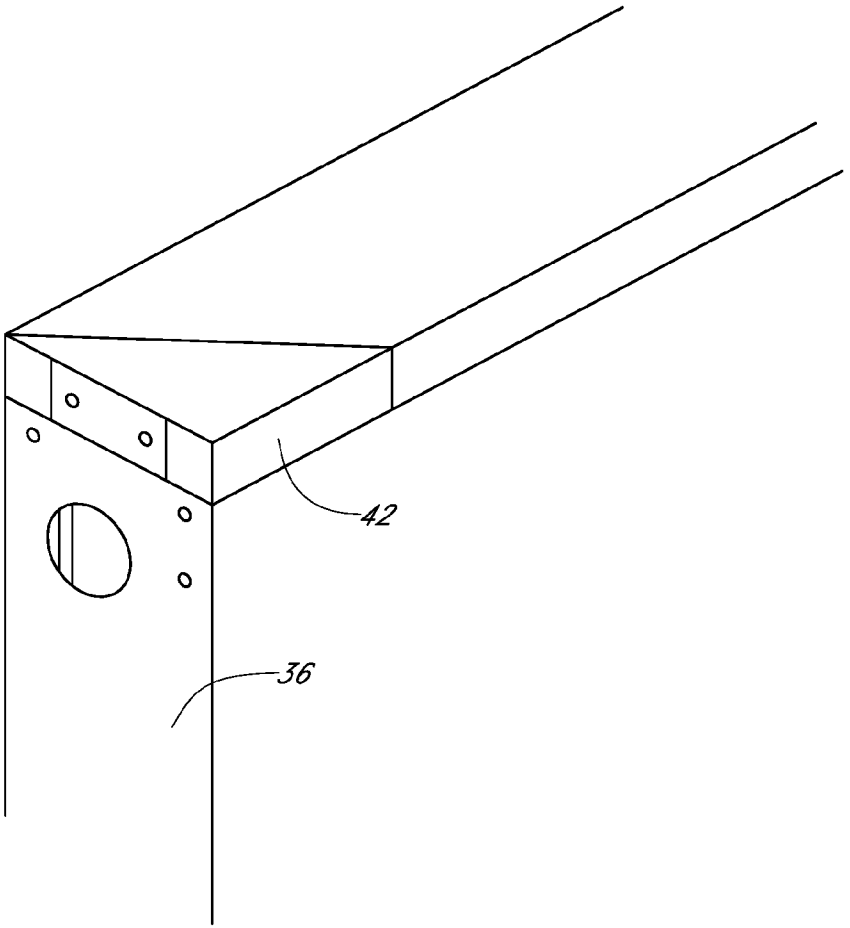
FIG. 13 illustrates a corner liner plate.
Figure 15:
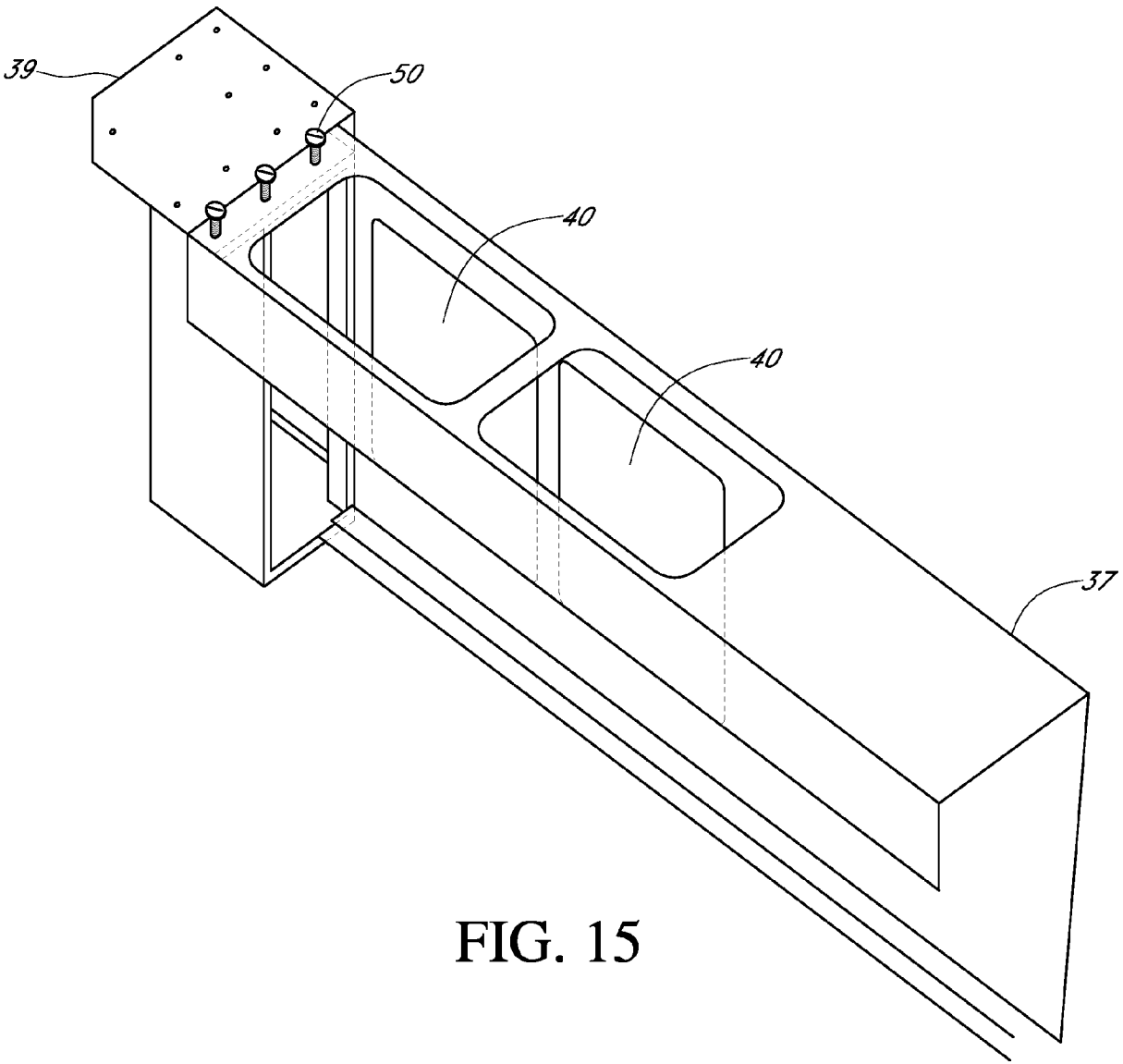
FIG. 15 illustrates the suction section of the water return channels shown in FIG. 14.
Figure 16:
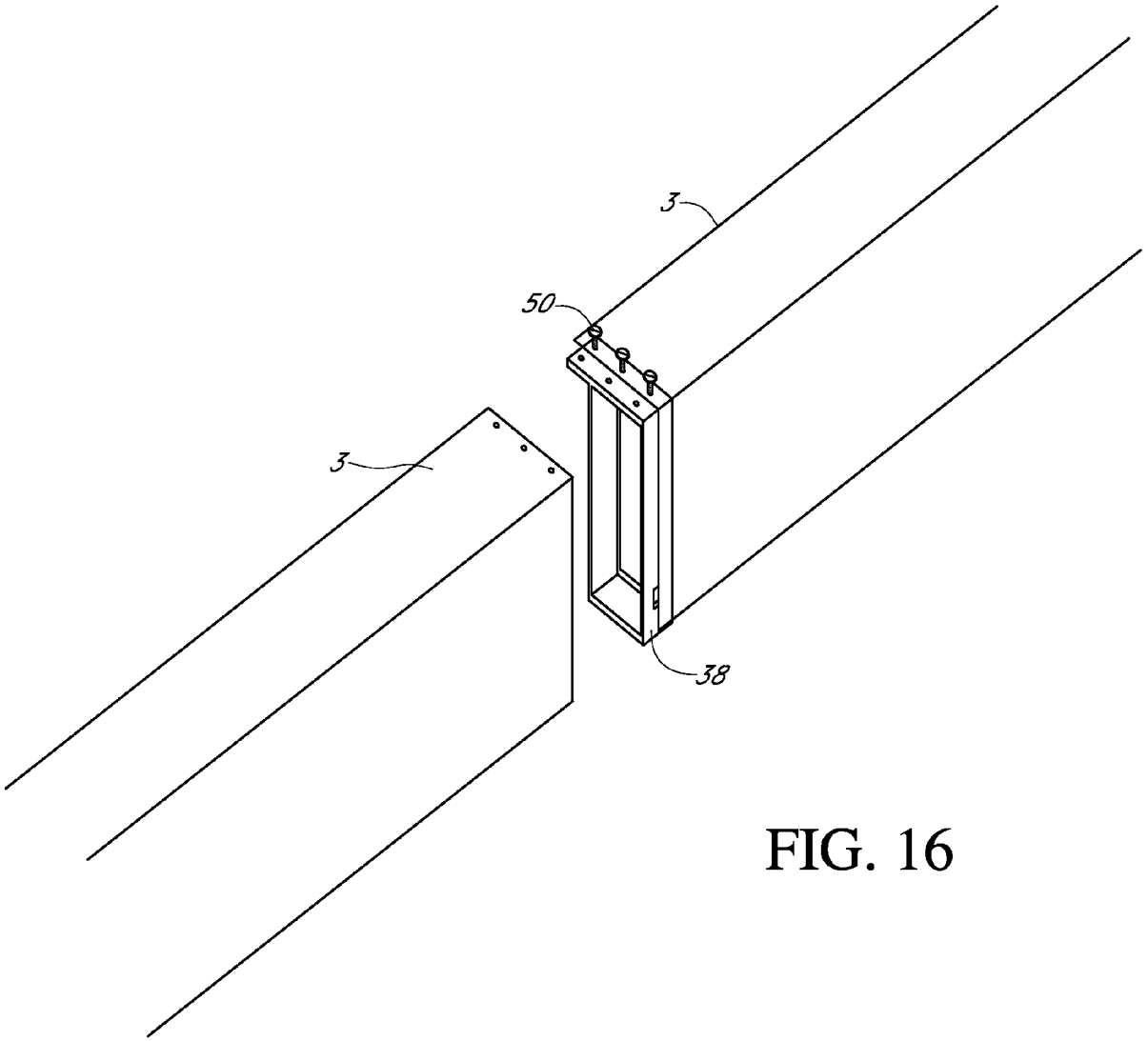
FIG. 16 illustrates an exploded view of the water return channels of the present art.

FIG. 13 illustrates a top seat pie stiffener 42 positioned at the upper portion of the wall and deck support 36 where engages with the walkway 30. FIG. 14 illustrates the water return channels of the present art. FIG. 16 illustrates an exploded view of the water return channels 3 of the present art. As shown the water return channels 3 may be segmented. As shown, water return channel 3 is composed of a first water return channel 3 connected to a second water return channel 3 at seam joint 38 using fasteners 50, such as nuts and bolts, as is well known to those of ordinary skill in the art. FIG. 15 further illustrates the suction tunnel 37 section of the water return channels 3 shown in FIGS. 14 and 16. This portion of the water return channels is positioned at the end opposite the propulsion system 4.

It should be noted that the present invention is not limited to the specific embodiments pictured and described herein, but is intended to apply to all self-contained exercise pools. Modifications and alterations from the described embodiments will occur to those skilled in the art without departure from the spirit and scope of the present invention.

The invention claimed is:

1. A self-contained swimming pool for containment of water and generation of water currents therein for exercise, therapy and or rehabilitation of a user comprising:

a. A rigid frame exteriorly located and surrounding an inner water containment area having a first, a second, a third and a fourth side wherein said rigid frame further comprising:

1. a plurality of pool panels having a first and second side, said first side having a relatively smooth surface and positioned to face said inner water containment area;
2. a plurality of vertically orientated wall and deck supports positioned around the perimeter of said inner water containment area and wherein said second side of said plurality of pool panels attaches to said plurality of wall and deck supports;
3. a plurality of horizontally orientated wall supports having a first and second side connected to and between said plurality of vertically orientated wall and deck supports and wherein said first side of said plurality of horizontally orientated wall supports faces said second side of plurality of said pool panels;
4. a plurality of tension straps attached to said first, second, third and fourth sides, wherein a pre-determined number of said tension straps are positioned to connect said first side to said third side of said inner water containment area and a pre-determined number of said tension straps are positioned to connect said second side to said fourth side of said inner water containment area;
5. a plurality of wall seam connecting plates positioned at the upper exterior portion of said wall and deck supports for attachment of adjacent said plurality of wall and deck supports; and
6. a plurality of adjustable screw plates positioned at the lower exterior portion of said wall and deck supports for attachment of adjacent said plurality of wall and deck supports;

b. A set of water return channels in communication with said inner water containment area and positioned interior of said plurality of said pool panels;

c. A propulsion system in communication with said set of water return channels and said inner water containment area; and, d. A hydraulic system for driving said propulsion system using a hydraulic fluid to produce a current in said inner water containment area allowing positioning of a user in said current for exercise, therapy and or rehabilitation therein and wherein said hydraulic system is self-contained and mounted external of said rigid frame.

2. The self-contained swimming pool for containment of water and generation of water currents therein for exercise, therapy and or rehabilitation of a user according to claim 1 wherein said water produces outward forces that when placed upon said tension strap ends lock said tension straps ends against said openings in said lower portion of said plurality of said wall and deck supports.

3. The self-contained swimming pool for containment of water and generation of water currents therein for exercise, therapy and or rehabilitation of a user according to claim 2 wherein said plurality of tension straps are horizontally orientated and each said tension strap has a first and second end, said first end and second ends having a vertical portion therein for insertion into a vertical opening in said lower portion of wall and deck supports wherein said vertical portion of said tension strap is perpendicular with said wall and deck support.

4. The self-contained swimming pool as set forth in claim 2 wherein a decorative horizontal surface may be placed upon said rigid frame to surround said inner water containment area.

5. The self-contained swimming pool as set forth in claim 2 wherein said rigid frame is composed of modular interlocking panels.

6. The self-contained swimming pool as set forth in claim 5 wherein said modular interlocking panels are opposedly positioned for increased structural rigidity.

7. The self-contained swimming pool as set forth in claim 6 wherein said modular interlocking panels are connected by tension straps to further improve structural rigidity.

* * * * *